US011841018B2

(12) United States Patent
Liang et al.

(10) Patent No.: US 11,841,018 B2
(45) Date of Patent: Dec. 12, 2023

(54) ALL-METAL CONICAL COMBINED SCREW PUMP SUITABLE FOR PETROLEUM FIELD

(71) Applicant: WUXI HENGXIN BEISHI TECHNOLOGY CO., LTD, Jiangsu (CN)

(72) Inventors: Haiyang Liang, Jiangsu (CN); Guang Zhou, Jiangsu (CN); Zhihai Zhang, Jiangsu (CN)

(73) Assignee: WUXI HENGXIN BEISHI TECHNOLOGY CO., LTD, Jiangsu (CN)

( * ) Notice: Subject to any disclaimer, the term of this patent is extended or adjusted under 35 U.S.C. 154(b) by 229 days.

(21) Appl. No.: 17/425,314

(22) PCT Filed: Oct. 28, 2019

(86) PCT No.: PCT/CN2019/113652
§ 371 (c)(1),
(2) Date: Jul. 22, 2021

(87) PCT Pub. No.: WO2020/151279
PCT Pub. Date: Jul. 30, 2020

(65) Prior Publication Data

US 2022/0090599 A1 Mar. 24, 2022

(30) Foreign Application Priority Data

Jan. 25, 2019 (CN) ..... 201910071838.2

(51) Int. Cl.
*F04C 2/16* (2006.01)
*E21B 43/12* (2006.01)
*F04C 15/00* (2006.01)

(52) U.S. Cl.
CPC ..... *F04C 2/16* (2013.01); *E21B 43/121* (2013.01); *F04C 15/0057* (2013.01);
(Continued)

(58) Field of Classification Search
CPC ..... F04C 15/0057; F04C 15/0061; F04C 2240/60; F04C 13/008
See application file for complete search history.

(56) References Cited

U.S. PATENT DOCUMENTS 2,192,588 A * 3/1940 Heckert ..... F04C 15/0061 277/366
2,619,040 A * 11/1952 Maisch ..... F04C 15/0061 418/206.7

(Continued)

FOREIGN PATENT DOCUMENTS

CN 101120173 A 2/2008
CN 104047846 A 9/2014

(Continued)

*Primary Examiner* — Anthony Ayala Delgado

(57) ABSTRACT

An all-metal conical combined screw pump suitable for petroleum field includes: a stator, a rotor, a sleeve and a sucker rod, wherein the internal threaded curved surface and the external threaded curved surface are both tapered The spiral structure and the taper are the same; the all-metal conical combined screw pump further comprises a movable part, a fixed part and a elastic part, the movable part is fixedly connected to the rotor, the fixed part is fixedly connected to the sucker rod, one end of the elastic member abuts against the movable part or the rotor, and the other end abuts against the fixed part or the sucker rod, the elastic member can Elastic contraction or elastic expansion along the sliding direction of the movable part.

11 Claims, 2 Drawing Sheets

(52) U.S. Cl.
CPC .... *F04C 2210/206* (2013.01); *F04C 2240/10* (2013.01); *F04C 2240/20* (2013.01); *F04C 2240/60* (2013.01)

(56) References Cited

U.S. PATENT DOCUMENTS

| | | | | |
|---|---|---|---|---|
| 4,580,955 | A * | 4/1986 | Karge | E21B 23/00 418/5 |
| 11,638,660 | B2 * | 5/2023 | Balkenbush | A61M 1/77 606/107 |
| 2007/0074871 | A1 * | 4/2007 | Olson | E21B 43/121 166/381 |
| 2019/0316583 | A1 * | 10/2019 | Dicks | F04C 15/0061 |

FOREIGN PATENT DOCUMENTS

| | | | |
|---|---|---|---|
| CN | 206608311 | A | 11/2017 |
| CN | 109723637 | A | 5/2019 |
| WO | 2006063583 | 5 | 6/2006 |

* cited by examiner

ALL-METAL CONICAL COMBINED SCREW PUMP SUITABLE FOR PETROLEUM FIELD

BACKGROUND OF THE PRESENT INVENTION

Field of Invention

The present invention relates to the field of special pumps for petroleum exploitation, and more particularly to an all-metal conical combined screw pump suitable for the petroleum field.

Description of Related Arts

Gas injection oil recovery is aimed at viscous crude oil, injecting hot steam into the oil field, so that the viscosity of the heavy oil is reduced, thereby facilitating exploitation.

Since hot steam will accelerate the aging of the rubber of the rubber screw pump, the rubber screw pump is lifted and taken out when the gas is injected, resulting in a long time-consuming work and low efficiency. The stator and rotor of the all-metal screw pump are made of metal, which has strong high temperature resistance and does not need to be taken out during the gas injection process. Therefore, the all-metal screw pump has a unique advantage compared to the rubber screw pump when it is suitable for gas injection oil production.

SUMMARY OF THE PRESENT INVENTION

Technical Problems

The radial dimensions of the stator and the rotor of the conventional metal screw pump are kept uniform along the longitudinal direction. During use, the sand mixed in the crude oil will wear the stator and the rotor, causing the gap between the stator and the rotor to increase. Because the pumping pressure of the metal screw pump is reduced, and the pumping pressure is reduced, the crude oil cannot be pumped out, that is, the screw pump needs to be replaced, so the service life of the screw pump is short; in addition, when the pumping pressure is reduced or the power is cut off, sand is deposited in the gap between the stator and the rotor, and the rotor is easy to jam, that is, the phenomenon of sand jam occurs.

Technical Solutions

The invention provides an all-metal conical combined screw pump suitable for petroleum field, which can completely solve the technical problems of short service life and sand stuck of the existing all-metal screw pump.

The technical solution is such that an all-metal conical combined screw pump suitable for petroleum field comprises a stator, a rotor, a sleeve and a sucker rod, the stator is provided with an internally threaded curved surface, and the rotor is mounted on the stator, the stator is provided with an external threaded curved surface matched with the internal threaded curved surface, the sleeve is connected with the stator, and the sucker rod is installed in the sleeve, characterized in that: the internal threaded curved surface and the outer threaded curved surface are both tapered spiral structures and have the same taper, and the end of the inner threaded curved surface and the outer threaded curved surface with a larger radial size is connected to the sucker rod; the all-metal conical combined screw pump further comprises an elastic telescopic assembly, the elastic telescopic assembly comprising a movable part, a fixed part and an elastic part, the movable part is fixedly connected with the rotor, the fixed part is fixedly connected with the sucker rod, the movable part and the fixed part form a sliding fit on an above-below direction and can transmit torque to the sucker rod and the rotor. One end of the elastic member abuts the movable member or the rotor, and the other end abuts the fixed part or the sucker rod, the elastic member can be elastically contracted or elastically expanded along the sliding direction of the movable member.

Furthermore, the movable part is a connecting shaft, the fixed part is a connecting seat, the elastic part is a spring, the elastic telescopic assembly further comprises a limiting component, and the connecting shaft is inserted into the cavity of the connecting seat, the connecting shaft can move along the axis of the connecting seat and can transmit torque by cooperating with the connecting seat. The spring is sleeved outside the connecting shaft and/or the connecting seat. One end abuts against the connecting seat or the sucker rod, and the other end abuts against the connecting shaft or the rotor, and the limiting component is used to prevent the connecting shaft from being separated from the connecting seat.

Furthermore, the end of the rotor adjacent to the connecting shaft is connected with a first threaded joint, and the end of the connecting shaft adjacent to the rotor is connected with a second threaded joint, the first thread joint and the second threaded joint are connected by a threaded sleeve; the connecting seat is integrally formed or fixedly installed on the sucker rod.

Furthermore, the connecting shaft is provided with a step that is in position with a limit plate.

Furthermore, the movable part is a connecting seat, the fixed part is a connecting shaft, the elastic part is a spring, the elastic telescopic assembly further includes a limit component, and the connecting shaft is inserted in the cavity of the connecting seat, the connecting shaft can move along the axis of the connecting seat and can transmit torque by cooperating with the connecting seat. The spring is sleeved outside the connecting shaft and/or the connecting seat. One end abuts the connecting seat or the rotor, and the other end abuts the connecting shaft or the sucker rod, and the limiting component is used to prevent the connecting shaft from being separated from the connecting seat.

Furthermore, the limit component comprises a first outer flange and a limit plate that are in a limit fit, and the first outer flange is connected to the end of the connecting shaft adjacent to the connecting seat and, protruding outwards along a diameter direction, the limit plate is connected to the end of the connecting seat adjacent to the connecting shaft and protruding inward along the diameter direction.

Furthermore, the end of the connecting shaft adjacent to the first outer flange is provided with external teeth, the limit plate is provided with internal teeth, and the external teeth mesh with the internal teeth.

Furthermore, the first outer flange is provided with external teeth, the cavity is provided with internal teeth, and the external teeth mesh with the internal teeth.

Furthermore, the internal threaded curved surface is an M-head thread, the external thread is an N-head thread, the value of M is 2 to 4, the value of N is 1 to 3, and $M=N+1$.

Furthermore, the all-metal conical combined screw pump further includes an auger, the auger includes a central shaft and a spiral blade surrounding and fixed outside the central shaft, the auger is arranged between the rotor and the sucker rods and between two adjacent sucker rods, the two ends of the central shaft are respectively detachably fixedly connected with the corresponding rotor and the corresponding sucker rod.

Furthermore, the stator is integral or formed by two or more stator units fixedly connected in the axial direction.

Beneficial Effects

The beneficial effects of the present invention are as follows: (1) In the stator and rotor wear, the internal thread surface and the external thread surface wear uniformly, and the degree of wear is the same everywhere, because the internal thread surface and the external thread surface are both tapered spiral structures and tapered similarly, after being worn, adjusting the axial position of the rotor, that is, moving the rotor down, can make the outer threaded surface with a larger radial size on the upper side of the rotor before moving down and the worn diameter of the lower side of the stator after being moved down. Match with the larger inner spiral surface to realize that the gap between the adjusted inner and outer spiral surface still maintains the size before wear, thereby ensuring the pumping pressure of the all-metal conical combined screw pump and ensuring the crude oil pump. It can effectively extend the service life of the all-metal conical combined screw pump, and at the same time can improve the efficiency of the screw pump and reduce energy consumption. (2) After the stator and rotor are worn out, no additional labor is required. Through the elastic expansion of the elastic member in the elastic telescopic assembly and the rotor's own weight, the rotor moves downward relative to the sucker rod, so that the gap between the internal threaded surface and the external threaded surface can be automatically compensated, and the elastic effect of the elastic component can also ensure the rotor effective contact and sealing between the external thread surface and the internal thread surface of the stator, thereby achieving the maintenance of pump body pressure and pump efficiency, ensuring sand pumping out and avoiding sand sticking. (3) Ends with larger radial dimensions of the internal thread surface and the external thread surface of the rotor are close to the sucker rod. In use, the rotor and stator have a cone-shaped structure with a large top and a small bottom. Even if sand is deposited in the gap between the stator and the rotor after a power failure, the rotor is not easy to jam. (4) When the power is off, the sand is deposited in the gap between the stator and the rotor. After the power is turned on, during the rotation of the rotor, the deposited sand has an upward thrust on the rotor. At the same time, through the elastic contraction of the elastic member of the elastic telescopic assembly, the rotor has a relative space where the sucker rod moves upwards, and then the rotor moves upwards, the gap between the internal threaded surface and the external threaded surface becomes larger, to realize the release. (5) Through the elastic buffering of the elastic parts of the elastic telescopic assembly, in the assembly process, Can avoid the rotor injury. (6) The present invention also adds auger, the auger still has a conveying effect on the sand that is pumped up by the rotor and then falls down. Specifically, each auger has an upward push to the falling sand. The sand forms a continuous cycle of rising-falling between adjacent augers, which can effectively prevent sand from depositing between the rotor and the stator, thereby effectively reducing wear and extending the service life of the pump. (7), When the meter displays that the liquid output is decreased, each auger is still in rotating work, maintains the upward push of the falling sand, and further prevents the rotor from jamming. Therefore, it can effectively avoid the torsion accumulation and the risk of fracture. (8) Even after a power failure, the sand can also be partially deposited on the spiral blades of each auger, reducing the accumulation in the gap between the stator and the rotor, and further avoiding the rotor jam. (9) Due to the extension of the service life of the all-metal conical combined screw pump, a replacement frequency thereof is reduced, thereby reducing the time consumption of replacing the all-metal conical combined screw pump, and increasing the crude oil output.

DETAILED DESCRIPTION OF THE PREFERRED EMBODIMENT

Figure 1:
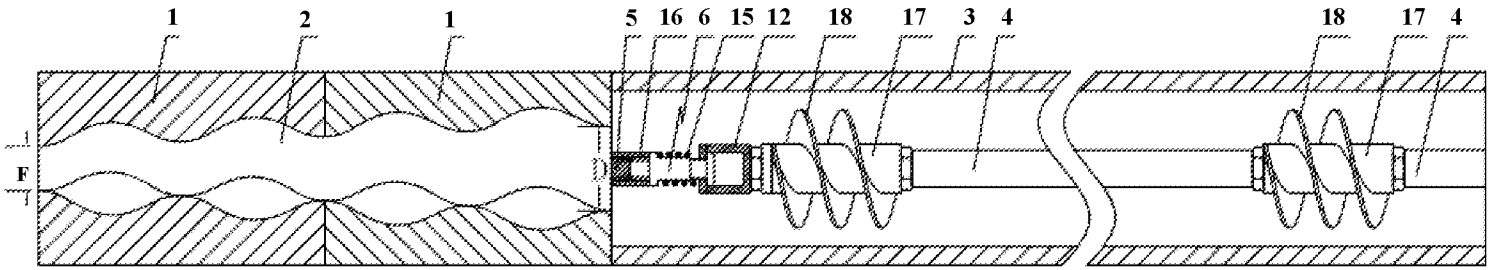
FIG. 1 is a schematic diagram of the structure of the all-metal conical combined screw pump of the present invention.
Figure 2:
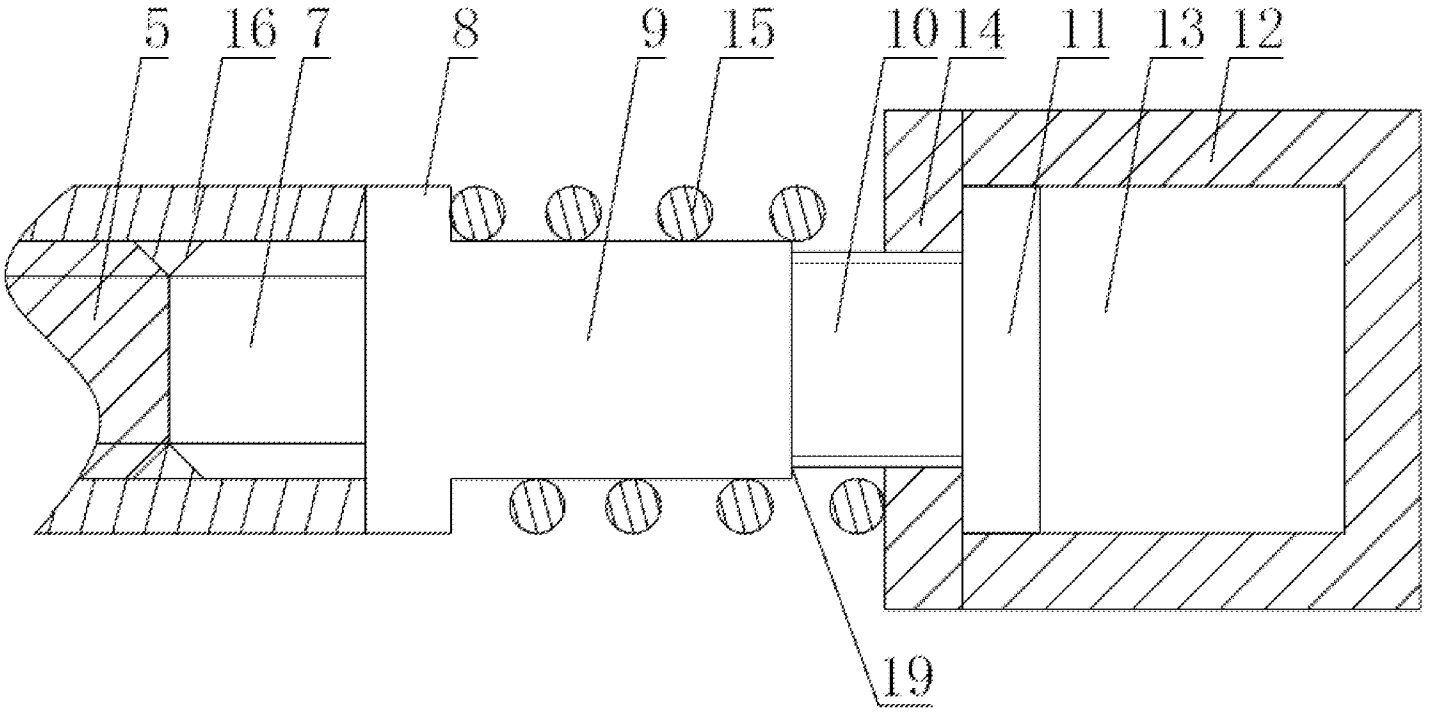
FIG. 2 is a schematic diagram of the structure of the elastic telescopic component of the present invention.

As shown in FIG. 1 and FIG. 2, an all-metal conical combined screw pump suitable for petroleum field comprises: a stator, a rotor 2, a sleeve 3 and a sucker rod 4; wherein the stator is formed by at least two stator units which are fixedly connected along an axial direction. The stator is provided with an internal threaded curved surface, the rotor 2 is installed in the stator and is provided with an external threaded curved surface matching the internal threaded curved surface, the internal threaded curved surface is a double-threaded thread, and the external thread is a single-threaded thread. In other embodiments, The M of the internal thread surface can also be 3 or 4, and the N of the external thread surface can also be 2 or 3, M=N+1, the stator is fixedly connected to the sleeve 3, and the sucker rod 4 is installed in the sleeve 3, the sucker rod as a whole is formed by a detachable and fixed connection of a number of sucker rods. The internal threaded surface and the external threaded surface are both tapered spiral structures and have the same taper. Ends with a larger radial dimension of the internal thread surface and the external thread surface of the rotor are close to the sucker rod 4. FIGS. 1 and 2 are in the side-placed state. The all-metal conical combined screw pump is in an upright state when in use, that is, the radial dimension of the upper end of the inner threaded surface and the outer threaded surface is larger compared with the radial dimension of the lower end. The all-metal conical combined screw pump also includes elastic telescopic assembly, The elastic telescopic assembly includes a movable part, a fixed part and an elastic part. The movable part is fixedly connected to the rotor, and the fixed part is fixedly connected to the sucker rod. The movable part and the fixed part are slidingly fitted in the upper and lower directions and can transmit torque to the sucker rod and the rotor. One end of the elastic piece abuts against the movable piece and the other end against the fixed piece. The elastic piece can elastically contract or expand along the sliding direction of the movable piece; specifically, the movable part is the connecting shaft 6 and the fixed part is the connecting seat 12, The elastic telescopic assembly further includes a spring 15 and a limiting component, and the connecting shaft 6 includes a second threaded connector 7, a second outer flange 8, a main body 9, an engaging portion 10, and a first outer flange 11 that are sequentially connected in the axial direction. The connecting seat is provided with a cavity 13 and a limiting plate 14 installed at the opening of the cavity 13 and extending inward in the diameter direction. The engaging portion 10 of the connecting shaft passes through the limiting plate, and the first outer flange 11 is inserted In the cavity 13 of the connecting seat 12, the connecting shaft 6 can move along the axial direction of the connecting seat 12. The end of the connecting shaft 6 adjacent to the first outer flange, that is, the engaging portion 10 is provided with external teeth, The limiting plate 14 is provided with internal teeth, and the external teeth mesh with the internal teeth, that is, in the form of splines, the connecting shaft can transmit torque by cooperating with the connecting seat 12. The spring 15 is sleeved outside the connecting shaft 6, and one end of the spring 15 abuts the connecting seat 12 and the other end abuts the second outer flange 8 of the connecting shaft to realize the functions of elastic expansion and contraction. The limiting component includes a first outer flange 11 and a limiting plate 14. The first outer flange 11 is connected to the connecting shaft 6 which is adjacent to the end of the connecting seat 12 and protruding outward in the diameter direction. The limiting plate 14 is connected to the end of the connecting seat 12 adjacent to the connecting shaft 6 and protruding inward in the diameter direction, passing through the position-limiting cooperation between the first outer flange 11 and the limiting plate 14 prevents the connecting shaft 6 from being separated from the connecting seat 12.

The end of the rotor adjacent to the connecting shaft 6 is connected with a first threaded joint 5, and the end of the connecting shaft 6 adjacent to the rotor is connected with a second threaded joint 7. The first threaded joint 5 connects with the second threaded joint 7 pass through a threaded sleeve 16; The connecting seat 12 is integrally formed at the lower end of the sucker rod or fixedly installed at the lower end of the sucker rod, wherein the fixed installation can be detachable by using a threaded structure.

Between the inner core portion 10 and the main body 9 of the connecting shaft is provided with a step 19 that is in position with the limit plate 14 to prevent the spring 15 from being compressed during assembly, protect the spring 15 and ensure the effective function of the spring 15.

The all-metal conical composite screw pump also includes an auger, which includes a central shaft 17 and a spiral blade 18 surrounding and fixed outside the central shaft 17. The auger is arranged between the rotor 2 and the sucker rod 4 and between two adjacent sucker rods 4, both ends of the central shaft 6 are detachably fixedly connected with the corresponding rotor 2 and the corresponding sucker rod 4 through a threaded structure and a lock nut 7; the diameter of the central shaft 17 is larger than that diameter of the sucker rod 4 to improve the connection strength of the auger.

What is claimed is:

1. An all-metal conical combined screw pump suitable for petroleum field comprising: a stator, a rotor, a sleeve and a sucker rod; wherein the stator is provided with an internally threaded curved surface, and the rotor is installed in the stator and is provided with the external threaded curved surface matched with an internal threaded curved surface, the sleeve is connected to the stator, and the sucker rod is installed in the sleeve, characterized in that: the internal threaded curved surface and the external threaded curved surface are both tapered the spiral structure and the taper are the same, and the end of the inner threaded surface and the outer threaded surface with the larger radial size is adjacent to the sucker rod; the all-metal conical combined screw pump further comprises an elastic telescopic assembly, the elastic telescopic assembly comprising a movable part, a fixed part and an elastic part, the movable part is fixedly connected to the rotor, the fixed part is fixedly connected to the sucker rod, the movable part and the fixed part are slidly fitted in the up and down directions and can transmit torque to the sucker rod and the rotor, one end of the elastic member abuts against the movable part or the rotor, and the other end abuts against the fixed part or the sucker rod, the elastic member can be elastically contracted or elastically expanded along the sliding direction of the movable part.

2. The all-metal conical combined screw pump suitable for petroleum field, as recited in claim 1, wherein the movable part is a connecting shaft, the fixed part is a connecting seat, the elastic part is a spring, the elastic telescopic assembly further comprises a limiting component, the connecting shaft is inserted into the cavity of the connecting seat, so the connecting shaft can move along the axis of the connecting seat and can transmit torque by cooperating with the connecting seat, the spring is sleeved on the connecting shaft and/or the connecting seat, and one end of the spring abuts against the connecting seat or the sucker rod, the other end abuts against the connecting shaft or the rotor, and the limiting component is used to prevent the connecting shaft from separating from the connecting seat.

3. The all-metal conical combined screw pump suitable for petroleum field, as recited in claim 2, the end of the rotor adjacent to the connecting shaft is connected with a first threaded joint, the end of the connecting shaft adjacent to the rotor is connected with a second threaded joint, the first threaded joint and the second thread are connected by a threaded sleeve; the connecting seat is integrally formed or fixedly installed on the sucker rod.

4. The all-metal conical combined screw pump suitable for petroleum field, as recited in claim 2, wherein the connecting shaft is provided with a step that cooperates with the position limit of a limit plate.

5. The all-metal conical combined screw pump suitable for petroleum field, as recited in claim 2, wherein the limiting component comprises a first outer flange and a limit plate that are in a limit fit, and the first outer flange is connected to the end of the connecting shaft adjacent to the connecting seat and protrudes outward in the diameter direction; the limit plate is connected to the end of the connecting seat adjacent to the connecting shaft and protrudes inward along the diameter direction.

6. The all-metal conical combined screw pump suitable for petroleum field, as recited in claim 5, wherein the end of the connecting shaft adjacent to the first outer flange is provided with external teeth, the limit plate is provided with internal teeth, and the external teeth mesh with the internal teeth.

7. The all-metal conical combined screw pump suitable for petroleum field, as recited in claim 5, the first outer flange is provided with external teeth, the cavity is provided with internal teeth, and the external teeth mesh with the internal teeth.

8. The all-metal conical combined screw pump suitable for petroleum field, as recited in claim 1, wherein the movable part is a connecting seat, the fixed part is a connecting shaft, the elastic part is a spring, the elastic telescopic assembly further comprises a limiting component, the connecting shaft is inserted into the cavity of the connecting seat, so the connecting shaft can move along the axis of the connecting seat and can transmit torque by cooperating with the connecting seat; the spring is sleeved on the connecting shaft and/or the connecting seat, and one end of the spring abuts against the connecting seat or the rotor, and the other end abuts against the connecting shaft or the sucker rod, and the limiting component is used to prevent the connecting shaft from separating from the connecting seat.

9. The all-metal conical combined screw pump suitable for petroleum field, as recited in claim 1, wherein the internal thread surface is an M-head thread, the external thread is an N-head thread, the value of M is 2 to 4, the value of N is 1 to 3, and M=N+1.

10. The all-metal conical combined screw pump suitable for petroleum field, as recited in claim 1, the all-metal conical combined screw pump further comprises an auger, the auger comprises a central shaft and a spiral blade surrounding and fixed outside the central shaft, the auger is arranged between the rotor and the sucker rod and between two adjacent sucker rods, the two ends of the central shaft are respectively detachably fixedly connected with the corresponding rotor and the corresponding sucker rod.

11. The all-metal conical combined screw pump suitable for petroleum field, as recited in claim 1, the stator is integral or formed by fixedly connecting two or more stator units in the axial direction.

* * * * *